United States Patent [19]

Hayashi

[11] 4,043,267

[45] Aug. 23, 1977

[54] ROCKET BULLET

[75] Inventor: Hisao Hayashi, Tokyo, Japan

[73] Assignee: Kabushiki Kaisha Kawaguchiya Hayashi Juho Kayaku-Ten, Tokyo, Japan

[21] Appl. No.: 488,442

[22] Filed: July 15, 1974

Related U.S. Application Data

[63] Continuation-in-part of Ser. No. 404,200, Oct. 9, 1973, abandoned, which is a continuation of Ser. No. 116,482, Feb. 8, 1971, abandoned.

[30] Foreign Application Priority Data

Aug. 27, 1970 Japan ..... 45-42393

[51] Int. Cl.[2] ..... F42B 5/02

[52] U.S. Cl. ..... 102/38; 102/42 R; 102/93

[58] Field of Search ..... 102/35, 42 R, 42 C, 102/93, 95

[56] References Cited

U.S. PATENT DOCUMENTS

| | | | |
|---|---|---|---|
| 2,414,863 | 1/1947 | Foster | 102/38 X |
| 3,058,420 | 10/1962 | Tanner et al. | 102/38 |
| 3,270,669 | 9/1966 | Atkins et al. | 102/95 X |
| 3,279,375 | 10/1966 | Herter | 102/95 |
| 3,283,720 | 11/1966 | Foote et al. | 102/95 X |
| 3,368,489 | 2/1968 | Herter | 102/95 |
| 3,394,654 | 7/1968 | Hayashi | 102/42 C X |
| 3,487,779 | 1/1970 | Hendricks | 102/42C |
| 3,590,740 | 7/1971 | Herter | 102/42 C |
| 3,713,388 | 1/1973 | Pontoriero | 102/95 X |

FOREIGN PATENT DOCUMENTS

| | | | |
|---|---|---|---|
| 2,018,748 | 2/1970 | Germany | 102/42 C |

*Primary Examiner*—Harold Tudor
*Attorney, Agent, or Firm*—Toren, McGeady and Stanger

[57] ABSTRACT

A firearm cartridge assembly consists of a casing having a bullet mounted in one end and an explosive charge in the opposite end with a wad extending between the two end elements. The wad has a generally cylindrical configuration and includes a first end and a second end each containing a similarly shaped recess. The first end in the assembled position contacts the explosive charge and the second end contacts the trailing end surface of the bullet. Located between and spaced axially from the ends of the wad is a centrally located disc-shaped section extending transversely of the axis extending between the ends and having an outer periphery generally conforming to and in surface contact with the inner surface of the casing so that the disc-shaped section forms a seal with the casing against gas leakage when the charge is exploded. In addition, spring sections, compressible in the axial direction of the casing, are located one between the first end and the disc-shaped section and the other between the opposite side of the disc-shaped section and the second end. Preferably the wad is integrally formed from a plastic material and it is symmetrical on the opposite sides of the disc-shaped section.

6 Claims, 23 Drawing Figures

INVENTOR.
HISAO HAYASHI
BY Toren and McGeady
ATTORNEYS

INVENTOR.
HISAO HAYASHI
BY Toren and McGeady
ATTORNEYS

INVENTOR.
HISAO HAYASHI
BY Toren and McGeady
ATTORNEYS

INVENTOR.
HISAO HAYASHI
BY Toren and McGeady
ATTORNEYS

ROCKET BULLET

This is a continuation-in-part of application Ser. No. 404,200, filed Oct. 9, 1973, now abandoned, which, in turn was a continuation of application Ser. No. 116,482, filed Feb. 8, 1971, now abandoned.

BACKGROUND OF THE INVENTION

The present invention relates to a firearm cartridge assembly and, more particularly, to an improved wad structure for use in such an assembly. Furthermore, the improved wad structure of the invention affords a cartridge assembly which can be manufactured by automated or mass production techniques.

In conventional types of cartridge assemblies, it is necessary to insert each member of the assembly, oriented in a particular direction, into the cartridge casing in a particular order. As an example, known cartridge assemblies have included a powder charge, a holding member for the powder charge, a cushion member, a bullet receiving member and a bullet all arranged within the cartridge casing in the order listed and oriented in a particular direction. It has been found that such cartridge assemblies have certain disadvantages including the inability to be manufactured by automated or mass production techniques.

Another disadvantage of conventional cartridge assemblies is that the bullet is caused to revolve due to air resistance developed by rifling on its periphery as the bullet leaves the muzzle of a gun. The problem with such an arrangement is that the manner in which the bullet revolves does not generate a sufficient revolving speed to keep the axis of the bullet in proper alignment. As a result, the trajectory of the bullet becomes irregular and the precision with which it strikes a target is diminished.

In accordance with the present invention, the disadvantages experienced with conventional cartridge assemblies can be overcome, and a cartridge assembly can be provided which has a high degree of target precision and it can be manufactured with automated or mass production techniques. Moreover, the cartridge assembly of the present invention permits a reduction in the amount of kickback developed in the firearm when it is fired.

SUMMARY OF THE INVENTION

Briefly, the present invention may be described as a cartridge assembly including a tubular-shaped casing closed at one end and open at the other with a charge positioned within the casing at its closed end and a bullet located at its open end with a wad extending between them. The invention is particularly characterized by the structure of the wad which is an axially extending generally cylindrically-shaped member having a first end and a second end each disposed transversely of the axial direction. In the assembled position within the casing, the first end contacts the surface of the charge while the second end contacts the rearward face of the bullet. Equidistantly spaced from the first end and the second end and in generally parallel relationship with the ends is a disc-shaped section having an outer peripheral dimension or diameter generally conforming to the inner diameter of the casing. The disc-shaped section is spaced axially from both of the first and second ends and spring means are positioned between the ends and the disc-shaped section which can be resiliently compressed when the cartridge is fired. Preferably, the wad is formed symmetrically on the opposite sides of the disc-shaped section as an integral or unitary member and it is formed of a resilient material, such as a synthetic resin material, for instance, polyethylene.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
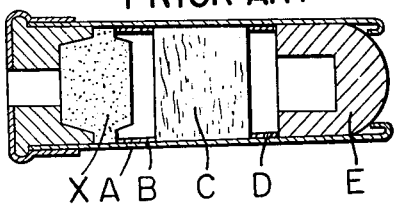
FIG. 1 PRIOR ART
FIG. 1 is a longitudinal sectional view of a conventional cartridge assembly in accordance with the prior art.
Figure 2:
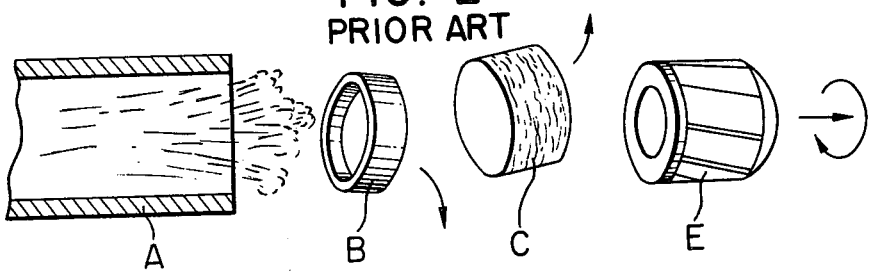
FIG. 2 PRIOR ART
FIG. 2 is a perspective view of the assembly of FIG. 1 shown immediately following the firing of the cartridge.

In the drawings, FIGS. 1 and 2 depict the structure of a prior art cartridge assembly which includes an explosive charge X, a charge holding member B, a cushion or wad member C, a bullet receiving member D, and a bullet E all located one following the other within a tubular casing A. In FIG. 2 the relative positions of the various elements is shown immediately after firing. It will be appreciated that a particular order of insertion of the elements within the cartridge casing A must be followed when the cartridge is assembled.

Figure 3A:
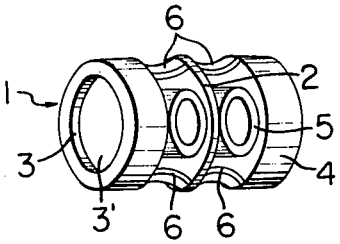
FIG. 3(a) is a perspective view of a wad formed in accordance with the present invention.
Figure 3B:
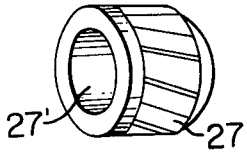
FIGS. 3(b) and 3(c) are perspective views of a bullet with rifling and a bullet without rifling, respectively.
Figure 3C:
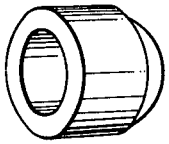
Figure 4:
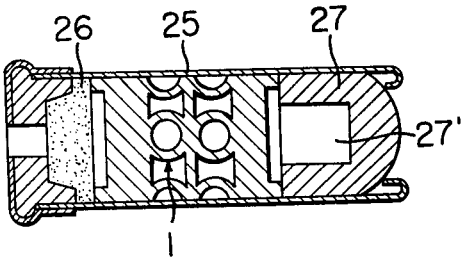
FIG. 4 is a longitudinal sectional view of a cartridge assembly incorporating the wad and bullet shown in FIGS. 3(a) and 3(b)

In FIGS. 3(a) -3(c) individual elements of a cartridge assembly in accordance with the present invention are illustrated. In FIG. 3(a), a generally cylindrically-shaped axially extending wad 1 is shown having a first end extending transversely of its axis and defining a charge engaging portion 3 containing a cylindrically-shaped recess 3'. At its other or second end, the wad has a bullet engaging portion 4 which has the same shape as the charge engaging portion 3, that is, it also has a cylindrically-shaped recess. The first and second ends of the wad are spaced axially apart and a disc-shaped partition wall 2 is equidistantly spaced from both of the ends and extends perpendicularly to the axis of the wad. Spring members are positioned extending between each of the opposite face surfaces of the partition wall 2 and the adjacent charge engaging portion 3 and bullet engaging portion 4. The spring members include tubular sections 5 and web-like sections 6 both having a resilient characteristic. The axes of the tubular sections 5 extend substantially perpendicularly to the axis of the wad and they are in surface contact with the facing surfaces of the partition wall 2 and the end engaging portions 3, 4. The web-like sections have an arcuately-shaped configuration when viewed in the axial direction of the wad and extend between the outer peripheral edge of the face surfaces of the partition wall 2 and the outer peripheral edges of the adjacent surfaces of the end engaging portions 3, 4. The outwardly facing surfaces of the web-like sections are concave. Further, the web-like sections 6 do not extend about the full circumferential periphery of the wad rather, they are located on opposite sides of the tubular sections and do not extend across the ends of the tubular sections. All of the individual sections which make up the wad are formed as an integral unit from a synthetic resin material which has a proper elasticity and strength in accordance with the conditions to be experienced within the cartridge assembly. One example of such a resin material is polyethylene. Furthermore, the wad is formed symmetrically on the opposite sides of its disc-shaped partition wall 2 so that during assembly it is not important which end is inserted against the charge. This feature is of particular importance in putting the cartridge assemblies together using automated or mass production procedures.

Figure 7A:
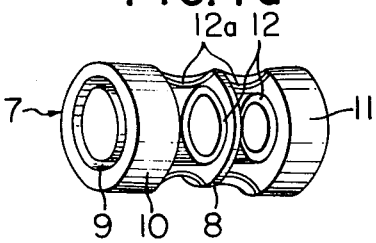
FIGS. 7(a) and 7(b) are perspective views of another embodiment of the wad and bullet embodying the present invention.

In FIG. 7(a), another embodiment of a wad 7 in accordance with the present invention is illustrated and includes a first end forming a charge engaging portion 10 in which an annular or ring-shaped groove is formed in the surface which contacts the charge. At the opposite end of the wad which has a cylindrical shape such as the wad shown in FIG. 3, a second end is provided forming a bullet engaging portion 11 which has the same shape as the other end engaging portion 10, that is, it also has a ring-shaped groove. Spaced between the two ends and extending transversely of the axis of the wad is a disc-shaped partition wall 8. Spring members are provided between both side surfaces of the partition wall 8 and the adjacent facing surfaces of the end engaging portions 10 and 11. The spring members consist of tubular sections 12 having their axes extending substantially perpendicularly to the axis of the cylindrically-shaped wad and web-shaped sections 12*a* each extending for a portion of the peripheral surface of the partition wall and end engaging portions on the opposite sides of the tubular sections 12. These web-shaped sections 12*a* have approximately the same configuration as the web-shaped sections 6 in FIG. 3(a). The various parts making up the wad are formed as an integral unit from a synthetic resin material having the proper elasticity and strength in accordance with the conditions to be experienced within a cartridge assembly. Further, as in the wad 1 of FIG. 3(a), the wad 7 is formed symmetrically on the opposite sides of the partition wall 8 and the basic differences between the wad 1 and the wad 7 is in the form of the recesses in the engaging end faces of the engaging portions 3 and 4 as compared to the annular grooves formed in the engaging end faces of the end engaging portions 10, 11.

Figure 11A:
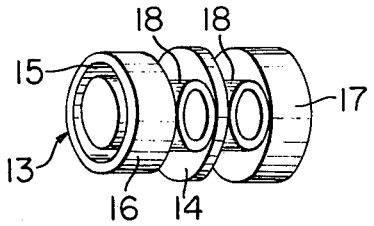
FIGS. 11(a) and 11(b) are perspective views of another embodiment of the wad and bullet in accordance with the present invention.

In FIG. 11(a) a wad 13 is shown affording a third embodiment of the present invention. Similar to wads 1 and 7, the wad 13 comprises a charge engaging end portion 16 and a bullet engaging end portion 17. The end face surfaces of the two end portions 16 and 17 which contact the charge and bullet, respectively, have an annular groove 15 generally similar to the annular groove 9 in the ends of the wad 7. However, the spring members in the wad 13 differ from the other two wads 1, 7 in that only tubular sections 18 extend between the facing surfaces of the disc-shaped partition wall 14 and the adjacent surfaces of the end portions 16 and 17. There are no web sections, such as sections 6 and 12*a*, in wad 13. As in the other wads, the various sections making up the wad are formed integrally from a synthetic plastic resin material and the various elements are arranged symmetrically about the disc-shaped partition wall 14.

Figure 15A:
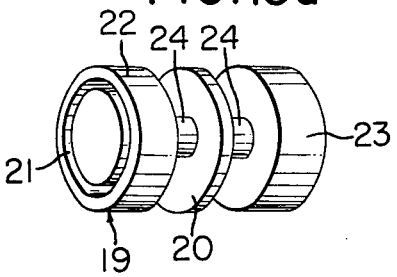
FIGS. 15(a) and 15(b) are perspective views of another embodiment of the wad and bullet in accordance with the present invention.

A fourth embodiment of the wad structure is depicted in FIG. 15(a) which illustrates a wad 19 having a charge engaging end portion 22 and a bullet engaging end portion 23. Though only the end face surface of the charge engaging end portion 22 is shown in FIG. 15(a), both of the end portions 22 and 23 have a ring-like groove 21 similar to the grooves 9 and 15 shown in FIGS. 7(a) and 11(a). A significant difference in the structure of the wad 19, as compared to the previously described wads, is the use of resilient solid cylindrical sections 24 extending in the axial direction of the wad as compared to the tubular sections in the other wads which extend transversely of the wad axis. As with the other wads, wad 19 is an integral or unitary structure formed of a synthetic plastic resin material.

Each of the wads described above and illustrated in the drawing is utilized in a cartridge assembly by positioning the wad between an explosive powder charge 26 located against the closed end of a cartridge case 25 and a bullet 27 located at the opposite end of the case. The assembled cartridge is shown in each of FIGS. 4, 8, 12 and 16. The cartridge case used in the assembly can be formed of plastic or paper. As indicated in FIGS. 3(b) and 3(c), the outer lateral surface of the bullet 27 can be provided with or without rifling. Further, the trailing end of the bullet within the cartridge assembly, that is the end facing toward the charge, has a recess 27' and in the assembled position of the cartridge before it is fired, the end face surface of the bullet engaging portion spans the recess 27'.

In assembling the cartridges embodying the present invention, the explosive powder charge 26 is seated into the closed end of the cartridge case 25 and it is pressed against the closed end and fixed exactly at a prescribed position by the end face surface of the charge engaging portion. Further, the charge engaging portion also acts as a gas check to prevent the explosive powder gases from leaking forwardly through the case immediately following the firing action. Moreover, the charge engaging portion located at the trailing end of the wad within the case operates as a piston against which the explosive powder gases act for propelling the bullet forwardly from the cartridge case. Additionally, the charge engaging portion provides a tailwing for the bullet 27 as it leaves the firearm muzzle, since the wad becomes fixed into the recess in the bullet, for maintaining the stability of the bullet's trajectory and to improve the precision with which it impacts against a target.

During assembly, the spring members of the wad are slightly compressed before the cartridge is fired. As can be noted in FIGS. 4, 8, 12 and 16, the bullet is held in the forward end of the case by an inwardly turned flange so that it presses rearwardly against the wad which in turn is compressed and forced rearwardly against the explosive charge. As a result, both the charge and the bullet are maintained within the cartridge case under a slight compressive force so that the charge and bullet are held in a stable position without play or clearance whereby the firing action of the cartridge can function properly. Immediately following firing of the cartridge assembly, the propulsive force generated by the explosive charge is applied against the charge engaging portion and is transmitted, suitably buffered, to the bullet engaging portion through the medium of the spring members, formed as shown in any of the embodiments of FIGS. 3(a), 7(a) and 11(a) with the principal object being to develop an enhanced cushioning effect, or a solid cylindrical configuration can be employed for the spring member as shown in FIG. 15(a), with the principal object being the attainment of improved manufacturing productivity and a more stable trajectory for the bullet propelled from the cartridge casing along with the wad. In FIGS. 5, 9, 13 and 17 the manner in which the spring members are compressed in response to the explosive powder gases is shown at the time the cartridge is fired. Initially, as can be seen from these figures, the bullet is held by the in-turned flange on the cartridge case and the wad is compressed forwardly against the trailing face surface of the bullet. In each of the embodiments the bullet engaging face surface of the wad is driven into the recess 27' in the bullet and a gradually increasing propulsive force is transmitted to the bullet. Due to the arrangement of the wad in the cartridge assembly, the kickback or reactive force normally occurring in a firearm when it is fired, is alleviated. Furthermore, at the moment the bullet and wad leave the muzzle, the forward push or force exerted by the explosive gases on the trailing end of the charge engaging portion is released and the wad functions as a trailwing on the bullet for improving the precision with which it can be directed at a target. By comparing FIGS. 5 and 6, 9 and 10, 13 and 14, and 17 and 18, the reorientation of the wad structure can be noted from the time it is fired within the cartridge case until it exits from the cartridge case and commences its trajectory path toward a target.

As the explosive gases within the cartridge case drive the wad forwardly against the bullet and before the bullet is displaced outwardly from the case, the face surface of the bullet engaging portion of the wad is compressed against the trailing face of the bullet so that the bullet engaging portion is driven into the recess 27' in the bullet. As mentioned, the wad is formed of a synthetic plastic resin material which permits it to deform and conform to the surface of the recess in the bullet so that a gripping action is developed securing the wad to the bullet so that it forms a tailwing when the bullet assumes its path of trajectory toward the target upon leaving the cartridge case. In the various embodiments of the wad shown in the drawing, the bullet engaging portion deforms in different ways.

Figure 5:
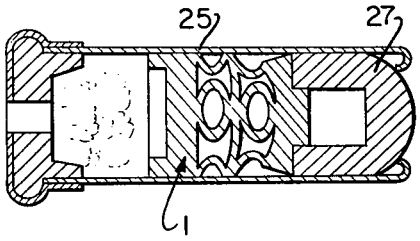
FIG. 5 is a sectional view, similar to FIG. 4, however, illustrating the structure of the cartridge assembly immediately following the ignition of its charge.
Figure 6:
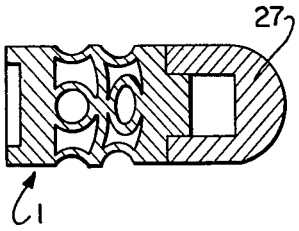
FIG. 6 is a sectional view of the wad and bullet shown in FIGS. 4 and 5 travelling in trajectory as a unit.

In FIG. 5 the annular outer portion of the face surface of the bullet engaging portion 4 contacting the annular trailing face of the bullet is compressed while the radially inner portion located about the axis of the wad and aligned with the recess 27' in the bullet is forced forwardly so that it enters into the recess, note FIG. 5, providing the attachment between the bullet and the wad. As can be seen in FIG. 5 the spring members are deformed and the deformation is at least partially relieved when the bullet and wad exit from the cartridge case. However, because of the movement of a part of the bullet engaging portion forwardly into the recess 27' in the bullet, the spring members extending between the bullet engaging portion and the disc-shaped partition wall are still in a deformed shape as the bullet and wad enter the path of trajectory.

Figure 10:
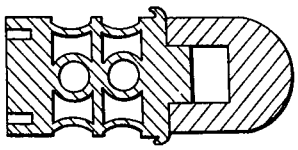
FIG. 10 is a longitudinal sectional view of the wad and bullet illustrated in FIG. 9 travelling in trajectory as a unit.
Figure 9:
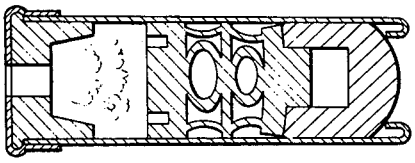
FIG. 9 is a longitudinal view of the cartridge assembly of FIG. 8 immediately following ignition of its charge.

In FIG. 9 the manner in which the wad 7 deforms as it is pressed forwardly against the trailing face of the bullet is shown with the radially outer part of the bullet engaging portion 11 being compressed and deformed rearwardly relative to the central portion which is forced forwardly into the recess 27' in the bullet. Prior to firing the cartridge assembly containing the wad 7, the face surface of the bullet engaging portion 11 in contact with the trailing surface of the bullet 27 has an annular groove, however, as the wad is pressed forwardly by the explosive gases and the central portion of the bullet engaging portion enters the recess 27' in the bullet, the deformation undergone by the wad is such that the annular groove is dissipated by the movement of the wad into the bullet recess. In FIG. 10 the bullet and wad are shown after leaving the cartridge case 25 and, since the case no longer limits the radially outward movement of the bullet engaging portion of the wad it spreads outwardly forming a lip or ring extending radially outwardly beyond the circumferential surface of the trailing edge of the bullet. With the wad discharged from the cartridge case it resumes the shape generally shown in FIG. 8. except for the deformation of the bullet engaging portion which it experiences as it is driven into the recess in the bullet.

In both FIGS. 5 and 9 the spring action of the wad is provided by the combination of the web-shaped sections **6, 12*a* and the tubular sections 5, 12. As can be seen in FIGS. 5 and 9** the spring members deform as the wad is driven forwardly against the trailing end of the bullet to provide a buffered action and most of the deformation experienced is released or relieved when the wad exits from the case except for that amount of deformation which remains because of the manner in which the wad is secured to the bullet.

Figure 13:
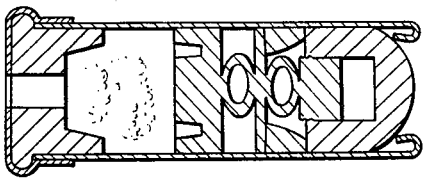
FIG. 13 is a longitudinal sectional view of the cartridge assembly of FIG. 12 immediately following ignition of its charge.
Figure 17:
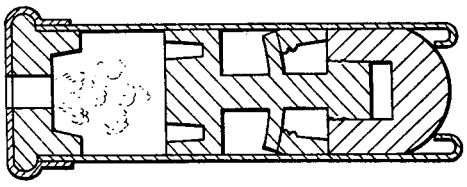
FIG. 17 is a longitudinal sectional view of the cartridge assembly of FIG. 16 immediately following ignition of its charge.
Figure 18:
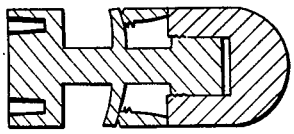
FIG. 18 is a sectional view showing the wad and bullet of FIG. 17 travelling in trajectory as a unit.

In the embodiments of FIGS. 5 and 9 the web-shaped sections 6, 12*a* afford a supporting action about the annular outer region of the bullet engaging portion, however, this supporting action is not present in the embodiments shown in FIGS. 13 and 17.

The differences in the structure of the wad in FIGS. 11(a) and 15(a) does not reside in the bullet engaging portion but in the spring members, in FIGS. 11–14 it can be noted that the spring members are tubular in form extending transversely of the axis of the wad while in FIGS. 15–18 the spring members are solid resilient members and extend coaxially with the wad providing a somewhat greater amount of rigidity in the manner in which the bullet engaging portion is forced axially into the recess 27' in the bullet. With regard to the bullet engaging portion the manner in which it deforms is the same in FIGS. 13, 14 and 17, 18. Accordingly, a description of the arrangement in FIGS. 13, 14 should be sufficient to afford an understanding of the deformation action which takes place.

In FIG. 13, as the explosive gases drive the wad forwardly against the trailing face of the bullet, the central region of the bullet engaging portion, inwardly of the annular groove formed in its face contacting the trailing end of the bullet is driven into the recess in the bullet. At the same time the portion of the bullet engaging portion radially outward of the annular groove is flattened or compressed against the annular surface of the trailing face of the bullet located outwardly of the recess. With the radially inner region of the bullet engaging portion 17 being compressed as it is driven into the recess 27' in the bullet 27 the edge portion of the recess 27' at the trailing edge face provides a cutting or shearing edge which separates the central region from the annular outer region. In other words, the annular outer region of the bullet engaging portion is separated from the central portion radially inwardly of the annular groove along or across the axially extending part of the bullet engaging portion extending between the base of the annular groove and the trailing face of the bullet engaging portion which is contacted by the tubular section 18. Because of the extent to which the central region of the bullet engaging portion of the wad is driven into the recess in the bullet, the annular portion which is separated from it, is held between the trailing face of the bullet and the juxtaposed face of the disc-shaped portion 14. The resilient action of the disc-shaped portion 14 is sufficient to hold the sheared annular section of the bullet engaging portion against the bullet when it assumes the configuration depicted in FIG. 14. In FIGS. 13, 14, 17 and 18 the sheared or cut surfaces of the bullet engaging portion are shown by jagged lines to indicate the manner in which the radially inner and outer parts of the bullet engaging portion separate as a result of the forward pressing of the wad into the recess in the bullet.

When the spring members are compressed as a result of the explosion of the charge, the centering of the wad is more surely maintained by the operation of the disc-shaped partition wall. The spring members extending between both sides of the partition wall and the bullet engaging portion and charge engaging portion are always compressed in a similar manner. After the bullet and the wad attached to it have been discharged from the cartridge case and the muzzle of the firearm, the partition wall serves to restore the charge engaging portion of the wad to its normal attitude. Furthermore, if a condition should develop within the cartridge case whereby gas from the exploded charge tends to leak forwardly around the periphery of the charge engaging portion at the time of firing and before the bullet exits from the muzzle of the firearm, the partition wall serves to impede the explosive gas flow forwardly toward the muzzle and to avoid leakage of the gas.

Figure 7B:
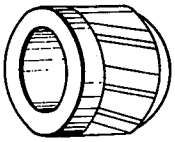
Figure 8:
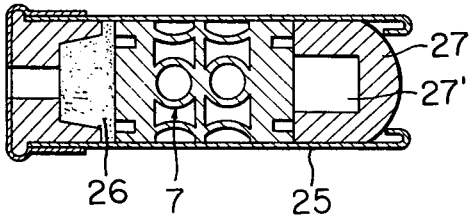
FIG. 8 is a longitudinal sectional view of a cartridge assembly incorporating the wad and bullet illustrated in FIGS. 7(a) and 7(b)
Figure 11B:
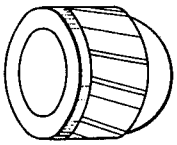
Figure 12:
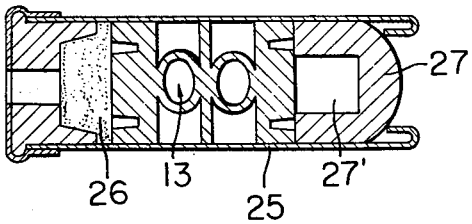
FIG. 12 is a longitudinal sectional view of a cartridge assembly incorporating the wad and bullet of FIGS. 11(a) and 11(b)
Figure 14:
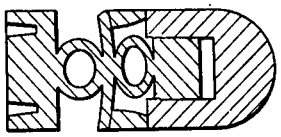
FIG. 14 is a longitudinal sectional view illustrating the wad and bullet of FIG. 13 travelling in trajectory as a unit.
Figure 15B:
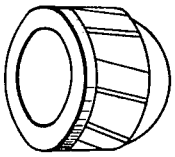
Figure 16:
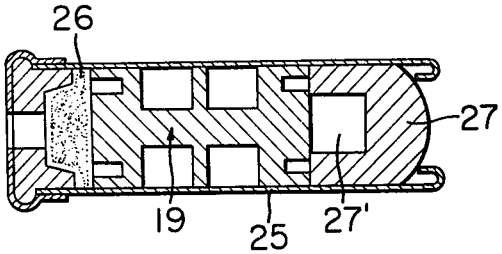
FIG. 16 is a sectional view of a cartridge assembly illustrating the wad and bullet of FIGS. 15(a) and 15(b)

The bullet engaging portion of the wad is maintained in close contact with the trailing face of the bullet by the action of the spring members which keep the bullet in a prescribed attitude. Due to the explosive pressure of at least 300 kg/cm$^2$ of the charge generated immediately after the firing of the cartridge assembly, the bullet engaging portion of the wad is forced into the recess in the bullet and becomes secured to it, as shown in FIGS. 6, 10, 14 and 18. Accordingly, the wad becomes fixed to the trailing end of the bullet and serves as a tailwing for it. For the bullet engaging portion of the wad which seats into the recess in the bullet, a simple recess 3' as shown in FIG. 3(a) is quite useful, if it is suitably designed in hardness, thickness and the like. However, if a ring-shaped groove is provided, having a slightly larger diameter than the inside diameter of the recess 27' of the bullet, as shown in FIGS. 7, 11 and 15, the tolerances required need not be as critical with regard to size, hardness and the like. The wad shown in FIGS. 7, 11 and 15 can be more surely fixed to the bullet after firing than can the wad illustrated in FIG. 3. As described above, the wad embodying the present invention consists of a charge engaging portion, a spring member portion, a disc-shaped partition wall and a bullet engaging portion all integrally formed together from a flexible resilient synthetic plastic resin material into a unitary wad, with the wad positioned between a powder charge and a bullet within the cartridge case of a cartridge assembly. One of the advantageous features of the cartridge assembly embodying the present invention is that the wad becomes secured to the trailing face of the bullet so that the wad forms a tailwing improving the precision with which the bullet can be directed at a target. Another advantageous feature of the wad formed as a unitary member symmetrical about the disc-shaped partition wall is that the wad can be inserted into a cartridge case without concern as to which end is inserted first. This feature makes it possible to manufacture the cartridge assemblies by automated or mass production procedures.

Still another advantageous feature of the present invention is the formation of the wad from a flexible and elastic synthetic plastic resin material so that a greater uniformity in shape, size, weight, hardness and elasticity can be maintained. As a result, greater stability can be achieved with respect to bullet speed, bore, pressure and the like as compared with a wad formed of a material such as cork, felt, fiber, animal hair, as are used in conventional wads.

Another significant characteristic of the wad is that, since it is formed of a synthetic resin material, it has an inherent elasticity which, together with the shape of the spring members, provides a cushioning effect so that the bullet is not propelled into motion in an abrupt or sudden manner by the development of the explosive gases when the charge is fired. Instead, a more gradual acceleration is transmitted to the bullet and, as a result, kick-back normally experienced in firearms is reduced. Moreover, with the wad securely fixed to the trailing end of the bullet it improves the accuracy with which the bullet can be directed at a target.

While specific embodiments of the invention have been shown and described in detail to illustrate the application of the inventive principles, it will be understood that the invention may be embodied otherwise without departing from such principles.

What is claimed is:

1. A firearm cartridge assembly comprising a cartridge casing closed at one end and open at the opposite end, said cartridge casing having an axially extending tubular configuration, a combustible charge contained within said casing at the closed end thereof, a single bullet mounted in and disposed in contact with said casing at the opposite open end thereof in axially spaced relationship with said combustible charge, and an integral wad member contained within said cartridge casing and extending between and in contact with said charge and said bullet, at least a portion of the axially extending lateral surfaces of said wad member being disposed in contact with said casing, said wad member formed of a flexible resilient synthetic resin material and comprising a first end located adjacent said charge and a second end located adjacent said bullet, said first end having a surface in engagement with said charge and said second end having a surface in engagement with said bullet, said charge engaging surface of said first end and said bullet engaging surface of said second end of said wad member each have a recess formed therein spaced radially inwardly from the outer periphery thereof, a disc-shaped section extending transversely of the axis of said casing and having the diameter of its outer peripheral edge conforming to the diameter of the interior of said casing and being located between and spaced in the axial direction of said casing from said first end and said second end, a first spring section disposed in contact with and located between said disc-shaped member and said first end and a second spring section disposed in contact with and located between said disc-shaped member and said second end, said first spring section and said first end located at one side of said disc-shaped member are symmetrical to said second spring section and said second end located on the opposite side of said disc-shaped member, said recess in said charge engaging surface wholly located within said first end and said recess in said bullet engaging surface wholly located within said second end, the base of said recess in said charge engaging surface spaced inwardly in said first end from said charge and the base of said recess in said bullet engaging surface spaced inwardly from said bullet and said recesses being similarly shaped and symmetrical about said disc-shaped section, means for retaining said charge and said bullet within said casing, said first and second spring sections arranged in compression in the axial direction of said casing for pressing said charge and said bullet against said means for retaining them in said casing, said bullet having a centrally arranged recess in the end thereof in contact with the bullet engaging surface of the second end of said wad with the recess in the bullet engaging surface extending axially away from the end of said bullet in contact wth the second end of said wad so that when the charge is exploded said bullet engaging surface is driven forwardly into the recess in said bullet forming a tightly fitting connection with said bullet due to the resilient character of the wad whereby said wad remains secured for said bullet acting as tailwing thereof over the trajectory of said bullet unti it contacts a target.

2. A cartridge assembly, as set forth in claim 1, wherein the recesses formed in the charge engaging surface and bullet engaging surface of said first and second ends, respectively, are in the form of a cylindrical cavity extending centrally and axially inwardly into said first and second ends.

3. A cartridge assembly, as set forth in claim 1, wherein said recesses formed in said charge engaging surface of said first end and said bullet engaging surface of said second end are in the form of an annularly-shaped groove disposed concentrically about the axis of said wad member.

4. A cartridge assembly, as set forth in claim 1, wherein said first spring section and said second spring section each comprise a solid cylindrical section of resilient material coaxially arranged relative to said casing with one of said sections extending between said first end and said disc-shaped member and the other said section extending between said disc-shaped member and said second end, and said cylindrical sections being axially compressible when said wad member is assembled between said bullet and said charge and when said wad member is subjected to the explosive force generated when the charge is ignited.

5. A cartridge assembly, as set forth in claim 1, wherein said first spring section and said second spring section each comprise a cylindrically shaped tubular section of resilient material having the axis thereof extending substantially perpendicularly to the axis of said casing and one of said sections extending between said first end and said disc-shaped member and the other section extending between said disc-shaped member and said second end, said tubular sections being compressible transversely to the axial direction thereof when said wad member is assembled in said casing between said charge and said bullet and when said wad member is subjected to the explosive force generated when the charge is ignited.

6. A cartridge assembly, as set forth in claim 1, wherein said first spring section and said second spring section each comprise a tubular section with the axis thereof extending substantially perpendicularly to the axis of said casing and a symmetrical arrangement of web-shaped sections, said tubular section and said web-shaped sections being formed of a resilient material, said first spring section located between said first end and said disc-shaped member and said second spring section located between said disc-shaped member and said second end, said tubular sections being arranged to extend between said disc-shaped member and the adjacent said end, said web-shaped sections having an arcuate configuration in the axial direction of said casing and being connected to and extending between said disc-shaped section and the adjacent said end, said web sections extending for a portion of the circumferential dimension of said disc-shaped member and being located on diametrically opposed sides of said tubular sections, said tubular sections and said web-shaped sections being axially compressible when said wad member is assembled in said casing between said charge and said bullet and also being compressible when subjected to the explosive force generated when the charge is ignited.

* * * * *